United States Patent [19]

Okabe

[11] 4,095,686

[45] Jun. 20, 1978

[54] PRINTER HAVING SWINGABLE PRINTING RINGS

[75] Inventor: Katsuhiko Okabe, Tokorozawa, Japan

[73] Assignee: Copal Company Limited, Tokyo, Japan

[21] Appl. No.: 812,375

[22] Filed: Jul. 1, 1977

[30] Foreign Application Priority Data

| | | |
|---|---|---|
| Jul. 7, 1976 | Japan | 51-80611 |
| Jul. 29, 1976 | Japan | 51-90674 |
| Aug. 21, 1976 | Japan | 51-100035 |
| Aug. 21, 1976 | Japan | 51-100036 |
| Aug. 26, 1976 | Japan | 51-114362[U] |
| Sep. 21, 1976 | Japan | 51-127242[U] |
| Sep. 22, 1976 | Japan | 51-128030[U] |

[51] Int. Cl.[2] ..... B41J 1/22

[52] U.S. Cl. ..... 400/150; 400/18; 400/162.3; 101/110; 101/97; 101/95; 400/151.1; 400/163.2; 400/161.3

[58] Field of Search ..... 101/94–99, 101/110, 93.43, 93.44; 197/18, 55

[56] References Cited

U.S. PATENT DOCUMENTS

| | | | |
|---|---|---|---|
| 2,945,091 | 7/1960 | Canepa | 197/55 |
| 3,353,648 | 11/1967 | Amada et al. | 197/55 |
| 3,378,127 | 4/1968 | Clary et al. | 101/110 X |
| 3,456,583 | 7/1969 | Priebs | 101/94 |
| 3,674,126 | 7/1972 | Decker et al. | 197/55 |
| 3,738,264 | 5/1973 | Sobottka et al. | 101/99 X |
| 3,973,488 | 8/1976 | Mielke | 101/99 X |

*Primary Examiner*—Edward M. Coven
*Attorney, Agent, or Firm*—J. Harold Nissen

[57] ABSTRACT

Printer having swingable printing rings which are selectively swung against a platen to print a line of selected characters on a paper by selecting a desired character from a plurality of characters provided on the periphery of each printing ring during the rotation thereof about its axis. Each printing ring is rotatably supported on a swingable printing ring supporting lever which is in turn swingably supported on a driving shaft. A plurality of driving gears are secured to the driving shaft and each of the driving gears meshes with a gear integral with the respective printing ring so as to rotate the same about its axis for selection of a desired character during the rotation thereof. Each printing ring supporting lever is urged by a spring so as to move the printing ring thereon apart from the platen. A plurality of driving levers are swingably supported on the driving shaft and each driving lever is engaged with the respective printing ring supporting lever.

18 Claims, 21 Drawing Figures

PRINTER HAVING SWINGABLE PRINTING RINGS

BACKGROUND OF THE INVENTION

The present invention relates to a printer having a plurality of individually swingable printing rings cooperating with a platen for printing a line of printing of desired characters on a paper by selectively swinging the printing rings upon issuance of printing signals from a control circuit of the printer so as to abut against the platen with the paper located therebetween after selection of a desired character on each printing ring during the rotation thereof.

In the prior art printer of the type having a plurality of individually actuatable printing rings for each figure of number, for example, the respective printing ring is coupled with a common driving shaft through a clutch resiliently connecting the both for permitting relative rotation therebetween when the respective printing ring is temporarily and selectively held stationarily for selection and arresting of a desired character thereon at a predetermined printing position in the printer upon issuance of character selection and printing signal from the control circuit of the printer while the driving shaft continues to rotate thereby permitting printing of a line of the desired characters on a paper in cooperation with the movable platen adapted to abut against the printing rings, and, after completion of the printing operation, the arresting of the respective printing ring is released so as to restore its initial position relative to the driving shaft to be ready for the next printing operation.

Such a prior art printer is very complicated in construction and troublesome in assembly requiring time consuming and expensive operations. Further, since the printing rings of such a printer must be instantaneously stopped their rotation for the printing of desired characters thereon, erroneous positioning of the printing rings necessarily occur resulting in false printing operation while the mechanism suffers from severe mechanical shocks occurring in the printer thereby shortening the life of the printer.

The present invention aims at avoiding the above described disadvantages of the above described prior art printer.

SUMMARY OF THE INVENTION

The object of the present invention is to provide a novel and useful printer which avoids the above described disadvantages of the prior art printer.

The above object is achieved in accordance with the present invention by providing a printer characterized by a plurality of swingable printing rings selectively swung against a platen to print a line of selected characters on a paper by selecting a desired character from a plurality of characters provided on the periphery of each printing ring during the rotation thereof about its axis, each printing ring being rotatably supported on a shaft secured to the free end of a swingable printing ring supporting lever which is swingably supported on a driving shaft, a plurality of driving gears secured to the driving shaft and each meshing with a gear integral with the respective printing ring so as to rotate the same about its axis for selection of a desired character during the rotation thereof, each printing ring supporting lever being urged by a spring so as to move the printing ring thereon apart from the platen, a plurality of driving levers swingably supported on the driving shaft and each engaged with the respective printing ring supporting lever and urged by a spring in the direction in which the printing ring supporting lever is urged to move the printing ring toward the platen, whereas each driving lever is releasably arrested by a select lever actuatable by an electromagnet so as to maintain the driving lever at a position at which the respective printing ring supporting lever engaging with the driving lever maintains the printing ring thereon apart from the platen, the select lever being permitted to be released from the driving lever when the respective electromagnet is selectively actuated by the printing signal of the printer in synchronism with the selection of a desired character on the printing ring thereby freeing the driving lever so that it urges the printing ring supporting lever by the action of the spring of the driving lever for moving the printing ring against the platen for the printing operation, a stopper for stopping the swinging of the respective driving lever at a position at which the printing ring urged thereby is freed from the driving lever to freely swing by the inertia thereof until the printing ring abuts against the platen for the printing so that, after abutment of the printing ring, the printing ring supporting lever is swung back by the spring thereof so as to be engaged with the driving lever which is stopped and held by the stopper thereby clearing the printing ring from the paper, and reset means driven by the driving shaft and urging the driving levers to their initial positions upon completion of the printing operation so as to be arrested by the select levers with the printing ring supporting levers being returned to their initial positions by their springs following the return of the driving levers so as to be ready for the next printing operation.

The starting and terminating of one cycle of printing operation may be controlled by a magnet adapted to be rotated by one revolution by the driving shaft for one cycle of the printing operation and a detecting reed switch cooperating therewith so as to issue an electrical signal applied to the control circuit.

The character selecting and synchronizing signal may be obtained by the provision of a detecting disc having circumferentially arranged slits corresponding in number to that of the characters and rotated by the driving shaft and a detecting device cooperating with the slits so that signals corresponding in angular phase to the characters on the respective printing ring are obtained which are applied to the control circuit so as to control the selection of a desired character on the respective printing ring.

DETAILED DESCRIPTION OF THE PREFERRED EMBODIMENTS

Figure 1:
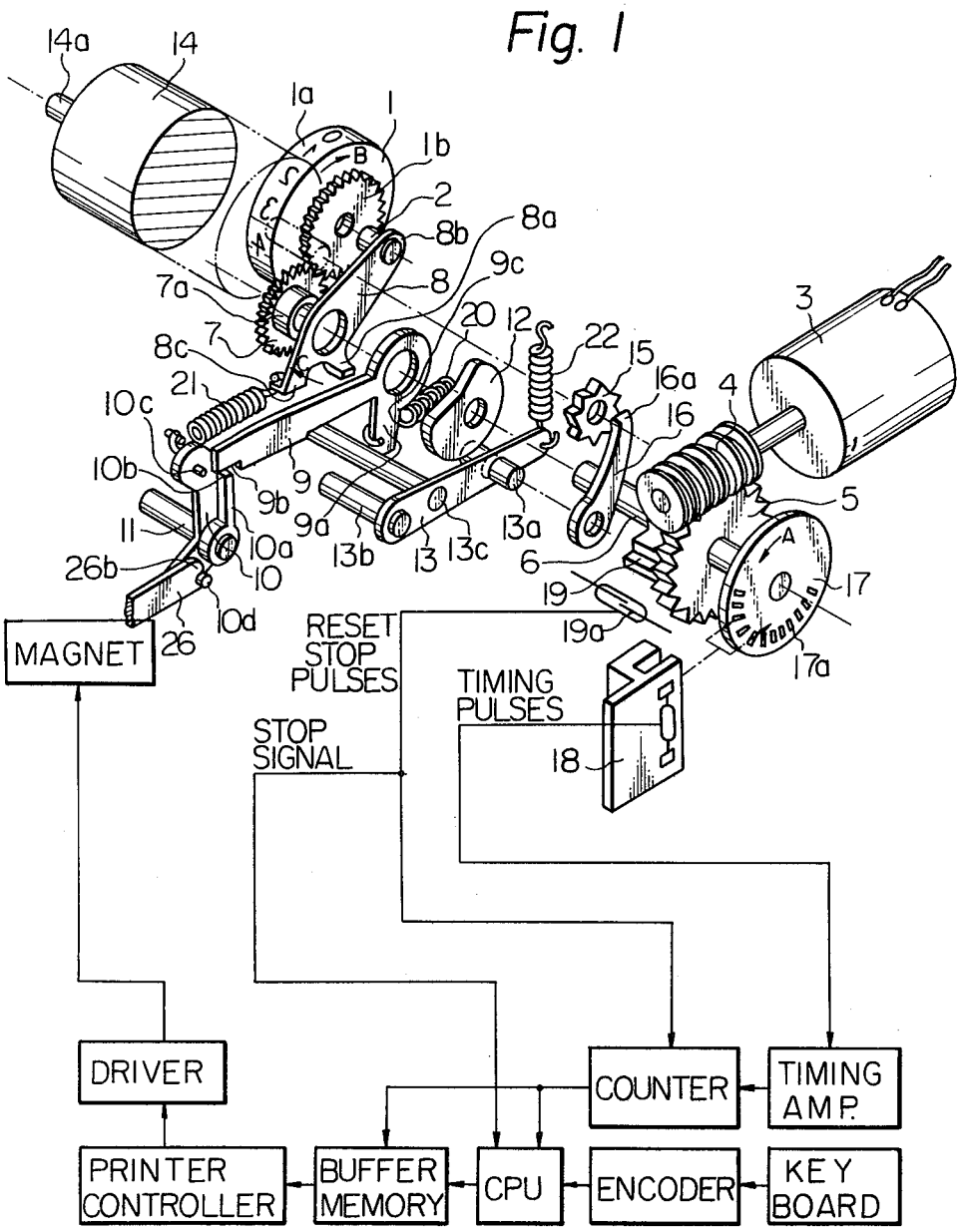
FIG. 1 is an exploded perspective view showing the main portions of an embodiment of the printer constructed in accordance with the present invention.

Referring to FIG. 1, a plurality of printing rings 1 are arranged in juxtaposed relationship adjacent to each other (only one ring 1 being shown in the drawing). Each printing ring 1 bears on at least a portion of the periphery thereof a series of printing characters 1*a* and is provided on its one side surface with a gear 1*b* integrally formed or secured thereto. Each printing ring 1 is rotatably supported by a shaft 2 secured to the free end 8*b* of a swingable printing ring supporting lever 8.

A drawing shaft 6 is provided which is driven by a driving motor 3 through a worm 4 secured to the shaft of the motor 3 and a worm wheel, 5 secured to the driving shaft 6 and engaging with the worm 4. A plurality of driving gears 7 each having a boss 7*a* are secured to the driving shaft 6 and each driving gear 7 meshes with the gear 1*b* of each printing ring 1 so as to rotate the same about its axis while each printing ring supporting lever 8 is swingably supported on the boss 7*a* of each driving gear 7 secured to the driving shaft 6 so that the respective printing ring 1 can be reciprocally moved toward and away from a platen 14 located parallelly adjacent to the respective printing ring 1 along an orbital path around the driving shaft 6 with each gear 1*b* held in meshing relationship with the respective driving gear 7.

The platen 14 is secured to a rotatable shaft 14*a* so that the platen 14 is rotated together with the shaft 14*a* when the latter is rotated.

Each printing ring supporting lever 8 is provided with a bent portion 8*c* to which one end of a spring 21 is attached to the machine frame of the printer so that the respective printing ring supporting lever 8 is urged by the spring 21 in the clockwise direction tending to move the respective printing ring 1 away from the platen 14.

Each printing ring supporting lever 8 is also provided with another bent portion 8*a* the function of which will be described later.

A plurality of swingable driving levers 9 are provided and each driving lever 9 is swingably supported on the boss 7*a* of each driving gear 7 and is provided with a substantially downwardly extending arm 9*a* adapted to engage with the bent portion 8*a* of the respective printing ring supporting lever 8 and a substantially horizontally extending arm having an arresting notch 9*b* formed at its tip. One end of a spring 20 is secured to the arm 9*a* while the other end of the spring 20 is secured to the machine frame of the printer so that the respective driving lever 9 is urged in the counterclockwise direction by the spring 20 thereby urging the printing ring supporting lever 8 in the same direction against the action of the spring 21 by virtue of the engagement of the arm 9*a* with the bent portion 8*a*.

The respective driving lever 9 is, however, normally arrested by a selective lever 10 to be described later at a position at which the respective printing ring supporting lever 8 is held so as to maintain the printing ring 1 thereon apart from the platen 14.

To this end, the respective select lever is pivotally supported by a shaft 11 and the upwardly extending arm 10*a* of the lever 10 has at its upper end an arresting shoulder 10*b* which is releasably engaged with the arresting notch 9*b* of the respective driving lever 9 so as to maintain the lever 9 at the above described position maintaining the printing ring 1 apart from the platen 14.

A pin 10*d* is secured to the free end of another arm of the respective select lever 10 extending substantially horizontally therefrom engages with bifurcated portion 26*b* of a swingable magnetically actuatable piece 26 (FIG. 2) pivotally supported by its pivot point 26*a* in a hole of a coil 27 forming an electromagnet member 24 together with a yoke 28. Similarly, a pin 10*c* is secured to the upper end of the arm 10*a* of the respective select lever 10, and the pin 10*c* engages with bifurcated portion 30*c* formed in the free end of a downwardly extending arm of a swingable lever 30 (FIG. 2) pivoted by a shaft 30*a*. A pin 30*b* is secured to the free end of a horizontally extending arm of the respective swingable lever 30, and the pin 30*b* engages with bifurcated portion 25*b* of a swingable magnetically actuatable piece 25 pivotally supported by its pivot point 25*a* in the other hole of the coil 27 in the electromagnet member 24.

Figure 2:
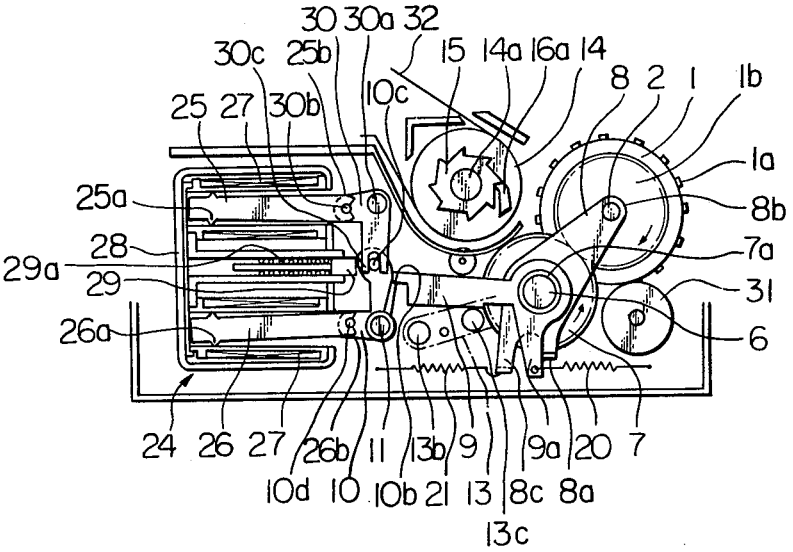
FIG. 2 is a schematic sectional side view showing the embodiment of FIG. 1.
Figure 3:
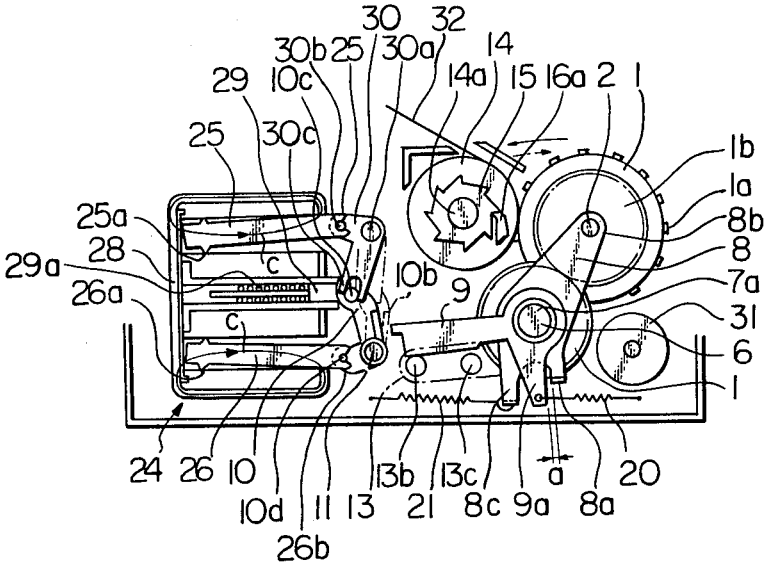
FIG. 3 is a view similar to FIG. 2 but showing the printer in another condition of operation thereof.

As seen in FIGS. 1 to 3, the upper end of the arm 10*a* of the respective select lever 10 is urged toward the right in FIG. 2 by a push rod 29 which is urged toward the right by a restoring spring 29*a* so that the respective select lever 10 is urged in the clockwise direction to engage the arresting notch 9*b* of the driving lever 9 with the arresting shoulder 10*b* of the select lever 10 and to urge the swingable magnetically actuatable piece 26 upwardly, while the swingable lever 30 is urged in the counterclockwise direction by the engagement of the pin 10*c* with the bifurcated portion 30*c* of the lever 30 so that the swingable magnetically actuatable piece 25 is urged downwardly. When the coil 27 is energized for a short time, magnetic flux c is generated through the yoke 28 and the pieces 25, 26 as seen in FIG. 3 so that the pieces 25 and 26 are forced to swing apart from each other thereby swinging the respective select lever 10 in the counterclockwise direction against the action of the spring 29*a* to release the respective driving lever 9 from the select lever 10. This allows the respective driving lever 9 to swing in the counterclockwise direction by the action of the spring 20 thereby swinging the respective printing ring supporting lever 8 in the same direction against the action of the spring 21 so that the printing ring 1 thereon is moved toward and against the platen 14 for the printing operation as described in detail hereinafter. The releasing of the respective driving lever 9 is selectively effected in timed relationship to the selection of a desired character on the respective printing ring 1 during the rotation thereof as described later for effecting printing of a line of desired characters.

Referring again to FIG. 1, a reset lever 13 is swingably supported by a shaft **13*b* extending in parallel to the driving shaft 6 beneath the horizontally extending arm of each driving lever 9. The shaft 13*b* is spaced a certain distance from the horizontally extending arm of each driving lever 9 when the driving lever 9 is arrested by the select lever 10. Thus, when the respective lever 9 is released from the select lever 10 and is swung in the counterclockwise direction urging the respective printing ring supporting lever 8 in the same direction so as to move the printing ring 1 thereon toward the platen 14, the driving lever 9 is stopped by the shaft 13*b* before the printing ring 1 abuts against the platen 14 and the printing ring supporting lever 8 is further swung together with the printing ring 1 thereon by the inertia thereof against the action of the spring 21 until the printing ring 1 abuts against the platen 14 for printing a selected character 1*a* on the respective printing ring 1 on a paper 32 sandwiched therebetween as described later, and, after the abutment, the printing ring supporting lever 8 is swung back by the action of the spring 21 so as to be held by the driving lever 9 which is now held by the shaft 13*b* thereby clearing the printing ring 1 from the paper to prevent the quality of printing on the paper 32** from being deteriorated.

Turning now to the description of the reset lever 13 per se, the lever 13 extends beneath the driving shaft 6 and is urged by a spring 22 in the counterclockwise direction and a cam follower shaft **13*a* secured to the lever 13 cooperates with a reset cam 12 secured to the driving shaft 6 so that the reset lever 13 is reciprocally swung up and down as the cam 12 is rotated by the driving shaft 6. A reset shaft 13*c* is secured to the reset lever 13 extending beneath the respective driving lever 9**.

The reset cam 12 is so configured with respect to the cam follower shaft **13*a* of the reset lever that, when the driving shaft begins to rotate at the beginning of one cycle of printing operation, the cam 12 urges the reset lever 13 downwardly so as to move the reset shaft 13*c* apart from the respective driving lever 9 thereby permitting the driving lever 9 to be swung in the counterclockwise direction after the same is released from the select lever 10 for effecting printing operation, but the reset lever 13 is swung upwardly at the end of one cycle of printing operation by the engagement of the cam follower shaft 13*a* with recessed portion of the cam 12 as it rotates so that the reset shaft 13*c* is moved upwardly to urge upwardly the respective driving lever 9 now held by the shaft 13*b* after releasing thereof from the select lever 10 so that the respective driving lever 9 is again arrested by the respective select lever 10 which has restored its position ready for arresting the driving lever 9 as shown in FIG. 2 by the deenergization of the coil 27 of the electromagnet member 24, the respective printing ring supporting lever 8 being returned to its initial position by the action of the spring 21 maintaining the printing ring 1 apart from the platen 14**.

In order to feed the paper 32 after completion of printing in each cycle of the printing operation, a ratchet 15 is secured to the rotatable shaft **14*a* of the platen 14 and a claw lever 16 having a claw 16*a* engaging with the ratchet 15 is pivotally supported by the cam follower shaft 13*a* or another shaft (not shown) secured to the reset lever 13. In order to insure the engagement of the claw 16*a* with the ratchet 15, a spring (not shown) is provided to urge the lever 16 toward the ratchet 15**.

Thus, when the reset lever 13 is swung upwardly for effecting the resetting of the respective driving lever 9 at the end of each cycle of printing operation as described above, the claw lever 16 is moved upwardly to rotate the ratchet 15 so that the rotatable shaft **14*a* is rotated together with the platen 14 thereby permitting the paper 32** located around the platen to be fed to be ready for the next printing operation.

In order to prevent the ratchet 15 from turning in reverse direction and insure positive feeding of the paper 32, a stopper claw (not shown) cooperating with the ratchet 15 may be provided.

In order to control the starting and stopping of one cycle of printing operation of the printer by a control circuit, a magnet 19 is provided which is moved around the driving shaft 6 together with the shaft 6 and a reed switch **19*a* is located adjacent to the path of movement of the magnet 19 so that a pulse is generated each time the magnet 19 moves across the reed switch 19*a* as the driving shaft 6** rotates. The pulse is applied to the control circuit so as to control the start and stop of the operation of the printer.

Figure 4:
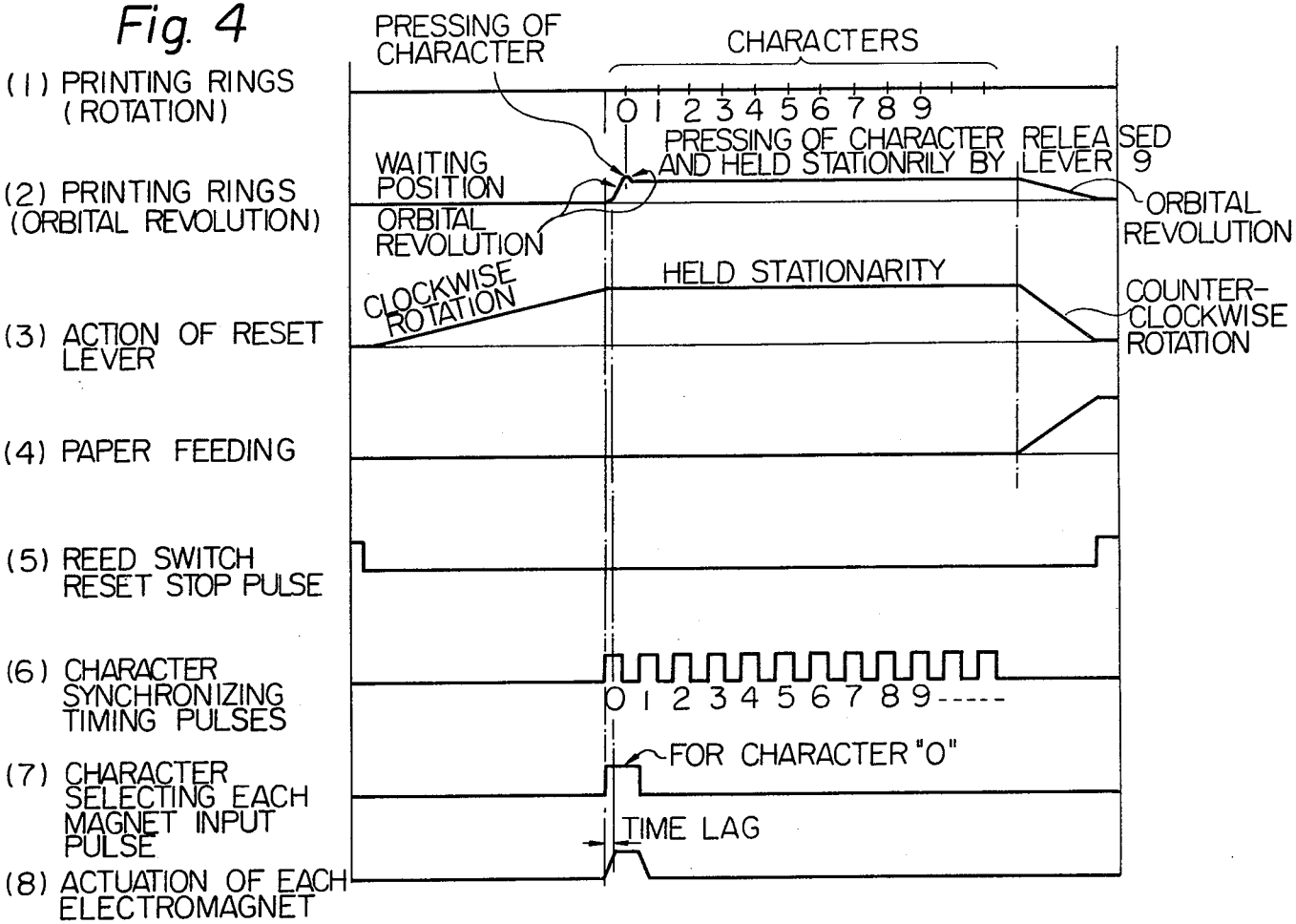
FIG. 4 is a diagram showing the time chart of operations of various components of the printer shown in FIG. 1.

In order to select a desired character 1a from the plurality of characters **1*a* of the respective printing ring 1 for the printing operation in timed relationship to the selective releasing of the respective driving lever 9 from the select lever 10 thereof by the actuation of the respective electromagnet member 24, a detecting disc 17 is secured to the driving shaft 6. The detecting disc 17 is provided with a series of slits 17*a* arranged equally spaced from each other along the periphery of the disc 17, and the number of the slits 17*a* corresponds to that of the characters 1a on each printing ring 1 so that the angular phase between the adjacent two slits 17*a* corresponds to the angular pitch formed between the adjacent two characters 1a on each printing ring 1. A detecting device 18 is provided straddling the periphery of the disc 17 and the detecting device 17 cooperates with the slits 17*a* so that a character synchronizing timing pulse is produced each time one slit 17*a* moves across the detecting device 18 as the driving shaft 6 rotates. The phase of each synchronizing timing pulse is slightly in advance of the passage of each character 1a across a predetermined printing position in the printer at which the printing ring 1 abuts against the platen 14 so as to compensate for the time lag caused by the mechanical actuation of each electromagnet member 24 after it is energized and the time period required for the orbital movement of the respective printing ring 1 around the driving shaft 6 for the printing operation as shown in FIG. 4. The character synchronizing timing pulses are applied to the control circuit for controlling the selective actuation of the respective printing ring 1 and the select lever 10** coupled therewith.

The control circuit applicable to the printer of the present invention comprises a key board, a key encoder, a CPU, an output put buffer memory, a printer controller, a timing amplifier, a counter and driver transistors connected as shown in FIG. 1.

The timing amplifier receives the character synchronizing timing pulses issued from the detecting device 18. The counter receiving the timing pulses from the timing amplifier also receives a reset stop signal from the reed switch 19*a* so as to seek the starting position of the operation of the printer to reset the counter and apply a stop signal to CPU in each printing operation.

Upon manipulation of the key board, the encoder usually comprising diode matrix encodes the input from the key board and applied the output thereof to the CPU for the operation thereof with the output of the counter being input to the CPU. The buffer memory receiving the output of the CPU and the counter stores the data for the printing operation maintaining the timed relationship to the actuation of the mechanical elements of the printer. The printer controller receiving the data from the buffer memory converts the data into printer driving signals which are supplied through the driver transistors to the driving motor 3 for driving the driving shaft 6 and the respective electromagnet member 24 actuating the select lever 10 for moving the respective printing ring 1 toward the platen 14 and for selection of the desired character 1a on the respective printing ring 1 during the rotation thereof in synchronized relationship therebetween.

The operation of the control circuit per se is not the subject matter of the present invention, and, therefore, detailed description thereof is omitted.

The operation of the above described printer of the present invention will be described with reference to FIG. 4 showing the time chart of the operations of various elements of the printer, wherein it is assumed that the gear ratio between the gears 7 and 1*b* is 1:1.

Upon issuance of a printing demand from the control circuit, the driving motor 3 is energized to drive the driving shaft 6 in the direction indicated by the arrow A through the worm 4 and the worm wheel 5. The respective printing ring 1 is then rotated in the direction indicated by the arrow B through the driving gear 7 and the gear 1b. At this time, each printing ring 1 is held apart from the platen 14 as shown in FIG. 1 due to the fact that the respective driving lever 9 is arrested by the select lever 10 so that each printing ring 1 is permitted to swing in the clockwise direction by the action of the spring 21.

At the beginning of the rotation of the driving shaft 6, the reset cam 12 urges the reset lever downwardly so that the reset shaft 13*c* is moved apart from the respective driving lever 9 thereby permitting the latter to be swung in the counterclockwise direction upon releasing thereof from the select lever 10.

Figure 6:
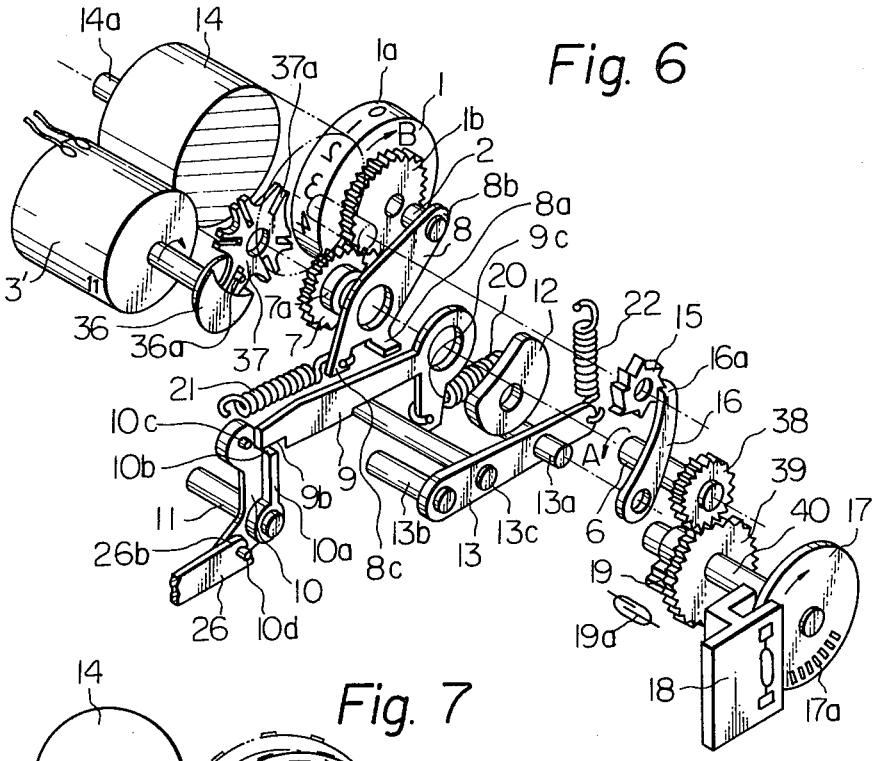
FIG. 6 is an exploded perspective view similar to FIG. 1 but showing a still other embodiment of the printer of the present invention.

The character synchronizing timing pulses ((6) in FIG. 6) are generated by the rotation of the detecting disc 17 cooperating with the detecting device 18.

The phases of the timing pulses are in advance to the respective angular phases of the characters 1*a* on the respective rotating printing rings 1 as seen in FIG. 4 (refer to (1) and (6) in FIG. 4) in order to exactly match the timing of the abutment of each printing ring 1 against the platen 14 after the actuation of the respective electromagnetic member 24 for releasing each select lever 10 for the orbital movement of the printing ring 1 with the timing of positioning a desired character 1a of each printing ring 1 at the printing position during the rotation of each printing ring 1 with the time lag of actuation of the mechanical elements including the magnetically actuatable pieces 25, 26 of the electromagnetic member 24 after energization of the coil 27 of thereof being compensated for.

In case the character "O" is to be selected for the printing operation, when the printing input signal from the key board as shown in (7) in FIG. 4 is generated in synchronized relation to the character synchronizing timing pulses corresponding to the character "O" as shown in (6) in FIG. 4, the coil 27 of the electromagnet member 24 corresponding to the character "O" is instantaneously energized through the control circuit of the printer, so that the magnetic flux path c is generated to force the movable electrically actuatable members 25, 26 to move apart from each other thereby releasing the select lever 10 from the driving lever 9 corresponding to the character "O."

Thus, the driving lever 9 is swung in the counterclockwise direction by the spring 20 as shown in FIG. 3 to urge the printing ring supporting lever 8 in the same direction to move the printing ring 1 in orbital path around the gear 7 and to abut the printing ring 1 thereon against the platen 14, while the printing ring 1 per se has been rotated about the shaft 2 thereof for positioning the character "O" at the printing position when the printing ring 1 abuts against the platen 14, thereby permitting the character "O" to be printed on the paper 32 sandwiched between the platen 14 and the printing ring 1.

In this case, the driving lever 9 is stopped by the shaft 13*b*, and the printing ring supporting lever 8 is swung further apart from the driving lever 9 by the inertia to abut the printing ring 1 thereon against the platen 14 for printing operation leaving the clearance a between the portion 8*a* and the portion 9*a* and, after the abutment, the printing ring supporting lever 8 is swung back by the spring 21 and is held by the driving lever 9 so that the printing ring 1 is held apart from the platen 14 by a clearance corresponding to the clearance a described above to clear the printing ring 1 from the paper 32.

The same applies to the case in which a character other than "O" is to be printed.

At the end of one revolution of the driving shaft 6, the cam follower shaft 13*a* of the reset lever 13 engages with the recessed portion of the reset cam 12 so that the reset lever 13 is swung upwardly by the spring 22 so that the reset shaft 13*c* urges the respective driving lever 9 in the clockwise direction together with the printing ring 1 whereby the respective driving lever 9 is arrested by the select lever 10 which has restored its arresting position by the deenergization of the electromagnet member 24. Thus, the printer is reset for the next printing operation.

The paper feeding operation is as follows.

At the beginning of one cycle of the printing operation, the claw lever 16 is lowered by the clockwise swinging movement of the reset lever 13 so that the claw 16*a* slides downwardly over the tooth of the ratchet 15, and, at the end of one revolution of the driving shaft, the reset lever 13 is swung in the counterclockwise direction as described previously, so that the claw lever 16 is moved upwardly thereby rotating the ratchet 15 in the counterclockwise direction by the engagement of the claw 16*a* with the ratchet 15 so as to feed the paper 32 located around the platen 14 at the end of one cycle of the printing operation.

In order to supply ink to the respective printing ring 1, an ink roller 31 is rotatably provided adjacent to each printing ring 1 so that, when the respective printing ring 1 is held at the position apart from the platen 14 by the arresting of the driving lever 9 by the select lever 10, the printing ring 1 is in contact with the ink roller 31 and, when one cycle of the printing operation is commenced and the respective printing ring 1 rotates, the ink roller 31 rolls around the periphery of each printing ring 1 so as to supply ink thereto.

One cycle of the printing operation is terminated by the reed switch 19*a* issuing the reset stop pulse at the end of one revolution of the driving shaft 6.

The operation of each of the elements of the printer is shown in FIG. 4.

In the above described embodiment of the present invention, the character to be printed on the paper 32 can be held stationarily during the time from the beginning of the orbital movement of the respective printing ring 1 to the completion of printing of the character so as to insure proper printing operation, when the ratio between the rotating speed of the driving shaft 6 and the speed of the orbital movement of the respective printing ring 1 is set appropriately.

Figure 5:
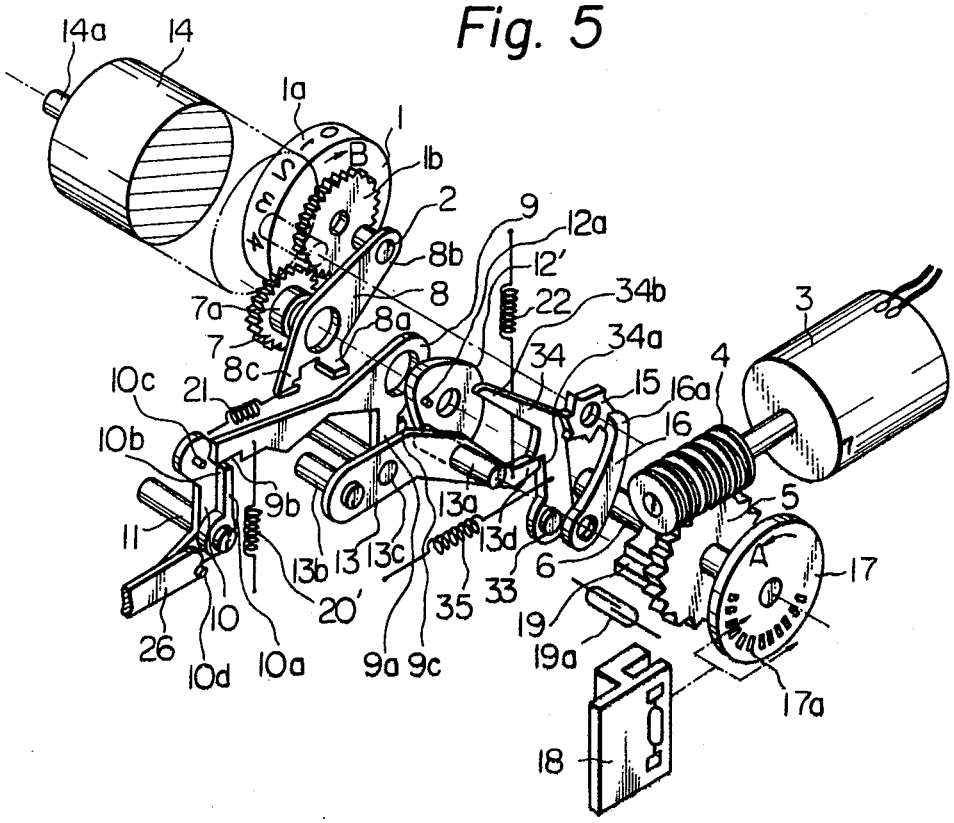
FIG. 5 is an exploded perspective view similar to FIG. 1 but showing another embodiment of the printer of the present invention.

FIG. 5 shows another embodiment of the present invention in which the reset lever 13 is held by a hook lever 34 without requiring the reset cam 12 to continuingly engage with the cam follower shaft 13*a* so as to permit the actuation of the respective driving lever 9 upon commencement of each cycle of the printing operation and it is released at the end of each cycle of the printing operation so as to reset the printer, thereby permitting the wear of the elements and loss of energy to be reduced because the frictional force between the cam 12 and the shaft 13*a* is avoided.

In this embodiment, the general construction is similar to that shown in FIG. 1 except that the reset lever 13 is formed with an engaging portion 13*d* at its tip while a hook lever 34 is pivotally supported by a shaft 33 adjacent to the engaging portion 13*d* of the reset lever 13 and urged by a spring 35 toward the engaging portion 13*d*. The hook lever 34 is formed with an arresting shoulder 34*a* adapted to cooperate with the engaging portion 13*d*. Further, the reset cam 12 is provided with a pin 12*a* adapted to engage with an elongated portion 34*b* of the hook lever 34 at the end of each cycle of the printing operation during the rotation of the cam 12.

In operation, when the selected electromagnet member 24 is actuated to release the select lever 10 after selection of the character on the printing ring 1, the reset lever 13 is also actuated by the cam 12 to free the driving lever 9, so that the engaging portion 13*d* is arrested by the arresting shoulder 34*a* of the hook lever 34. Thus, the reset lever 13 is held at this position without requiring the cam 12 to engage with the cam follower shaft 13*a* thereby reducing the frictional force and wear between the cam 12 and the shaft 13*a*. At the end of one cycle of the printing operation, the pin 12*a* of the cam 12 contacts and urges the elongated portion 34*b* of the hook lever 34 so that the lever 34 is swung in the clockwise direction to release the engaging portion 13*d* of the reset lever 13 thereby permitting the same to be swung upwardly by the spring 22 so reset the respective driving lever 9.

Figure 7:
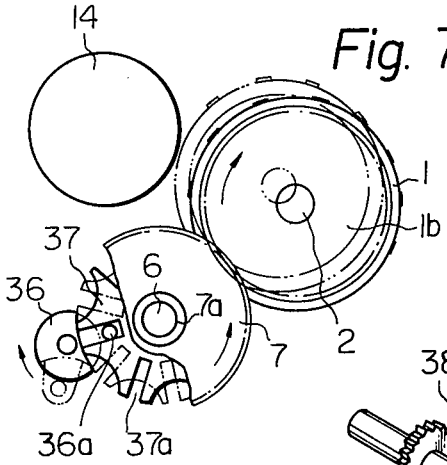
FIG. 7 is a fragmentary side view showing the operation of the Geneva gear mechanism used in the embodiment of FIG. 6.
Figure 8:
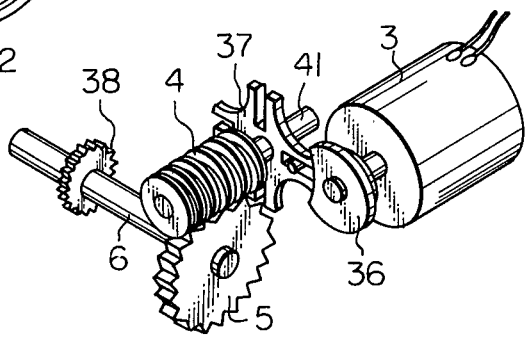
FIG. 8 is a fragmentary perspective view showing the alternative arrangement of the Geneva gear mechanism to that shown in FIG. 6.

FIGS. 7 and 8 show a still other embodiment of the present invention. In this embodiment, the general construction is similar to that shown in FIG. 1 except that an intermittent transmission mechanism such as a Geneva gear mechanism 36, 37 is interposed between the driving motor 3' and the driving shaft 6 and the detecting disc 17 supported by a shaft 40 is driven by the driving shaft 6 through gears 38, 39 so as to be rotated in synchronized relationship to the rotation of the respective printing ring 1 driven by the driving shaft 6 through the gears 7 and 1*b*.

The pin 36*a* secured to the driver disc 36 of the Geneva gear mechanism engages with the respective slot 37*a* (FIG. 7) formed in the driven gear disc 37 each time the driver disc 36 rotates one revolution so as to intermittently drive the driving shaft 6.

In this embodiment, the angular pitch between the adjacent two slots 37*a* of the driven gear disc 37 is greater than the angular pitch between the adjacent two characters 1*a* on each printing ring 1. However, by appropriately selecting the gear ratio of the gear 7 with respect to the gear 1*b*, the respective printing ring 1 can be rotated by one angular pitch each time the driven gear disc 37 is rotated intermittently by one pitch. Also, the angular pitch of the Geneva gear mechanism may be made the same as that of the printing ring 1.

FIG. 8 shows the modification of FIG. 6 wherein the Geneva gear mechanism 36, 37 is interposed between the driving motor 3 and the worm 4 engaging with the worm wheel 5 secured to the driving shaft 6. The operation is of this embodiment is similar to that shown in FIG. 6.

Figure 9:
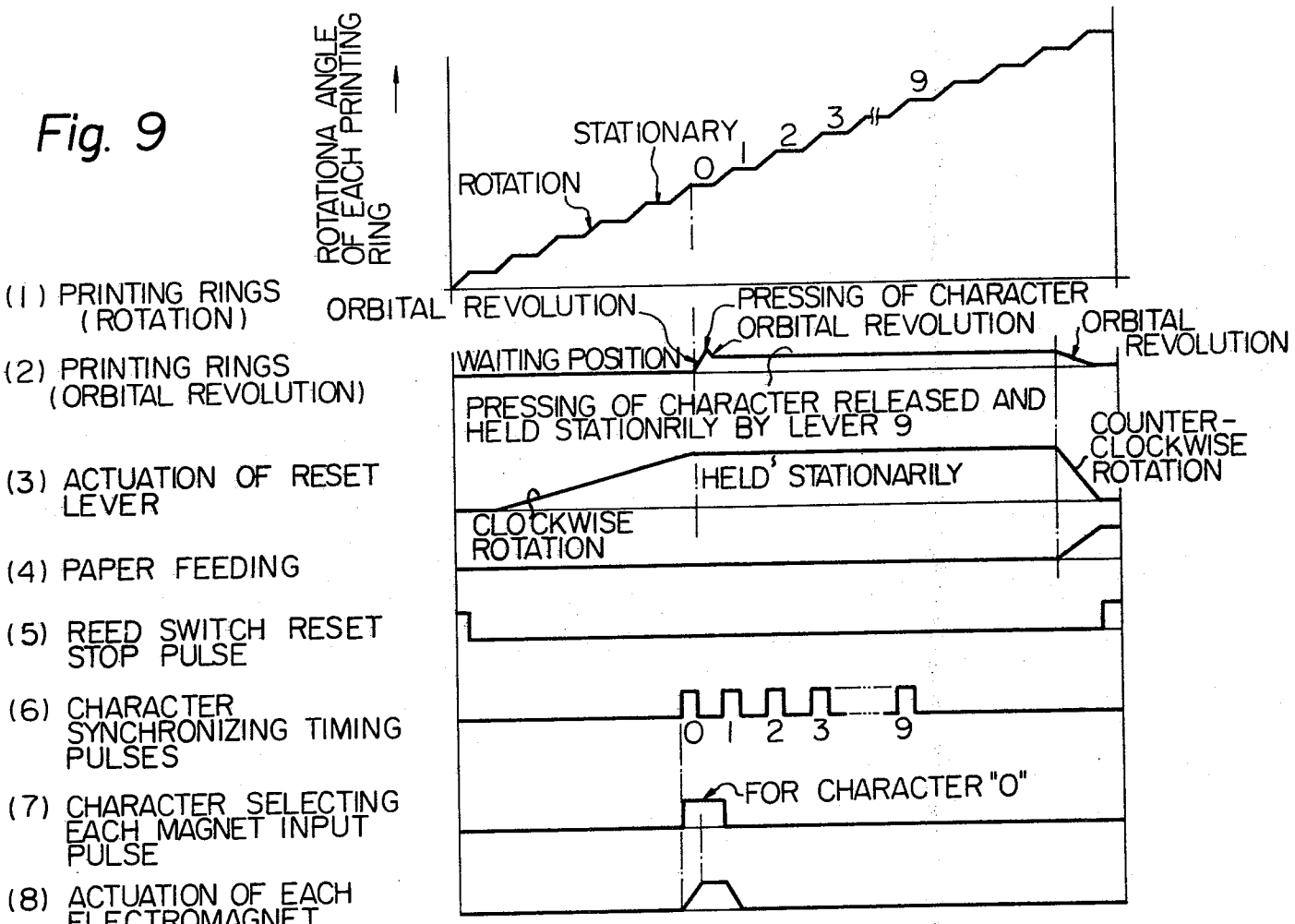
FIG. 9 is a diagram similar to FIG. 4 but showing the time chart of the embodiment of FIG. 6.

FIG. 9 shows the operation of the various elements in the embodiment shown in FIG. 6 or FIG. 8. The only difference between FIG. 4 and FIG. 9 is that, in the latter case, the respective printing ring 1 is rotated intermittently for selection of a desired character 1*a* on each printing ring 1.

Figure 10:
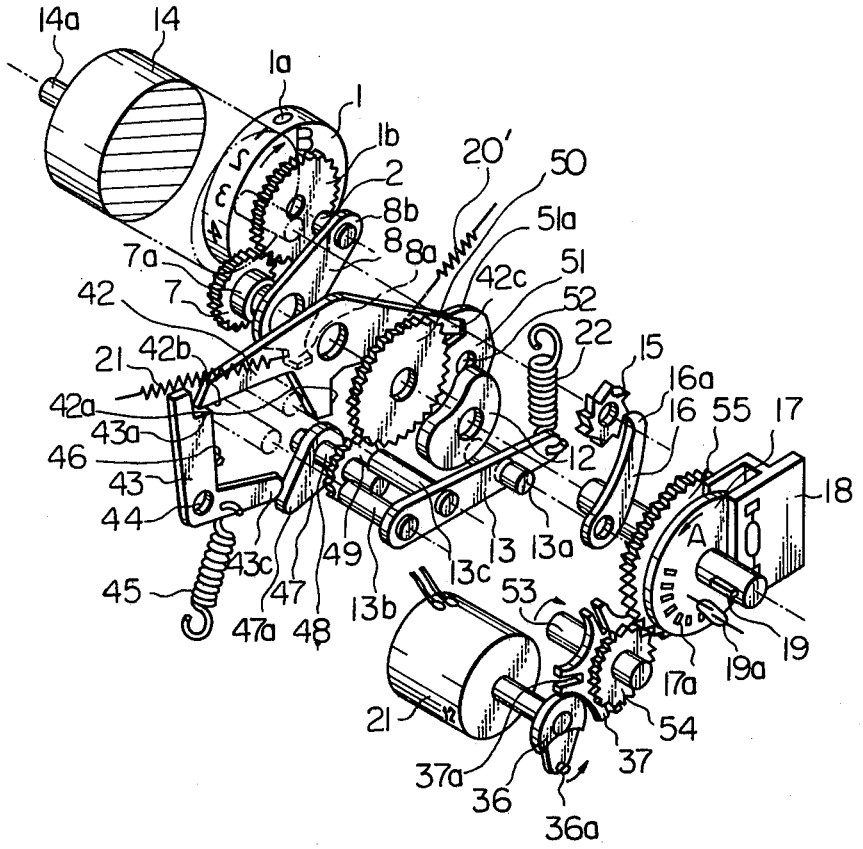
FIG. 10 is an exploded perspective view similar to FIG. 1 but showing a still further embodiment of the present invention.
Figure 11:
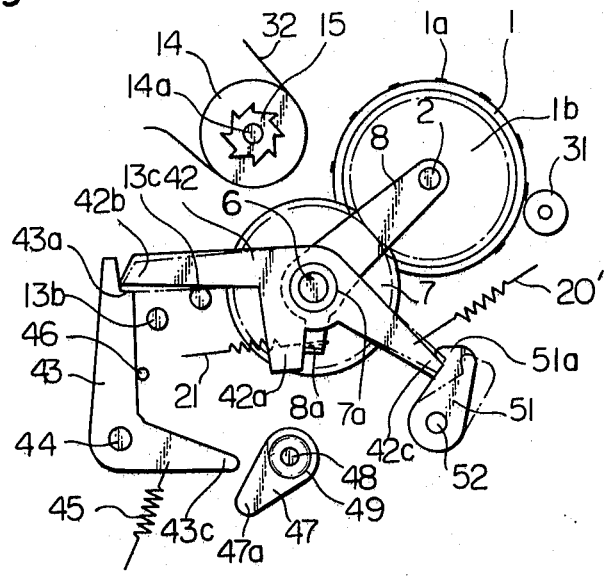
FIG. 11 is a schematic side view of FIG. 10.
Figure 12:
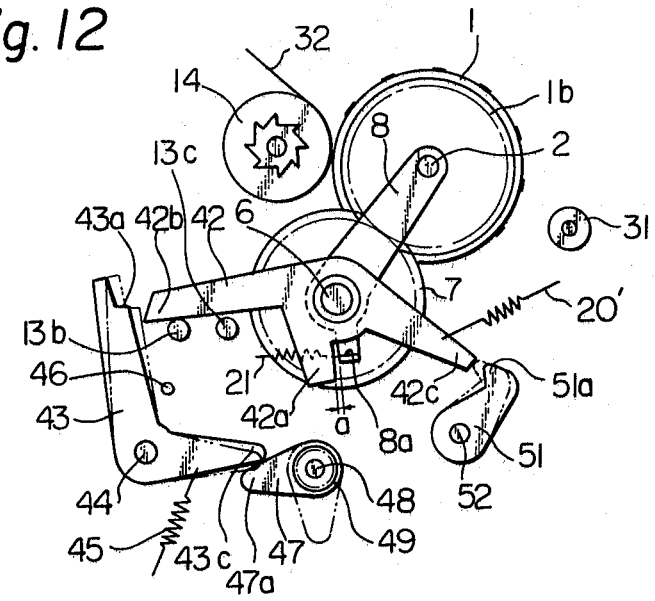
FIG. 12 is a view similar to FIG. 11 but showing the embodiment in another condition of operation.

FIGS. 10 to 12 show a further embodiment of the present invention. This embodiment is substantially similar to that shown in FIG. 1 but incorporates therein an intermittent transmission mechanism as in the case of the embodiment shown in FIG. 8 as well as means for positively synchronizing the actuation of the respective driving lever 42 for actuating the printing ring supporting lever 1 with the selection of a desired character 1a on each printing ring 1 during the rotation thereof regardless of the fluctuation of the time lag of the actuation of the magnetically actuatable members 25, 26 of each electromagnet member 24 upon energization of the coil 27 thereof.

In this embodiment, the entire construction is similar to that shown in FIG. 6 using an intermittent transmission mechanism such as the Geneva gear mechanism 36, 37, but the respective select lever is replaced by a lever 51 pivoted by a shaft 52 so as to releasably arrest the arm 42*c* of the driving lever 42 (corresponding to the driving lever 9 of FIG. 6 and urged by a spring 20') from the upper side thereof and an additional arm 42*b* is formed in the respective driving lever 42 extending in the substantially opposite direction therefrom to that of the arm 42*c* so as to be arrested by an arresting shoulder 43*a* of a release lever 43 pivoted about a shaft 44 and urged by a spring 45 in the clockwise direction. The other arm 43*c* of the release lever 43 is adapted to be engaged by a cam 47 secured to a shaft 48 which is driven by the driving shaft 6 through gears 49, 50 so that the respective cam 47 is rotated one revolution as each printing ring 1 is rotated by an angular pitch formed between the adjacent two characters 1a thereon so that the cam 47*a* of the cam 47 engages with the arm 43*c* of the release lever 43 in synchronized relation to the selection of the desired character (*a* on each printing ring 1 by the rotation of the respective printing ring 1.

In operation, when the desired character 1a is selected on each printing ring 1 and the select lever 51 is actuated to release the corresponding driving lever 42 by the actuation of the electromagnet member 24 for the orbital movement of the respective printing ring 1 for the printing operation, the release lever 43 still arrests the arm 42b of the driving lever 42 and, when the cam 47 engages with the release lever 43 in synchronized relationship with the selection of the desired character 1a on each printing ring 1 for the printing operation, the lever 43 is actuated to release the arm 42b of the driving lever 42 so that the respective printing ring supporting lever 8 is actuated for the orbital movement of the printing ring 1 in exact timed relation to the positioning of the selected character 1a regardless of the fluctuation in the time lag of the actuation of the respective electromagnet member 24 after the energization of the coil 27 thereof.

FIG. 11 shows the state of the above described embodiment wherein the driving lever 42 and the select lever 51 are shown by solid line in the arrested position, while the two-dot chain line shows the select lever 51 and the driving lever 42 in their disengaged positions with the arm 42b arrested by the release lever 43 and the cam 47 shown at a position prior to the engagement with the arm 43c of the release lever 43.

FIG. 12 shows in solid line the state wherein the select lever 51 has been actuated to release the arm 42c of the driving lever 42 and the raised portion 47a of the cam 47 has engaged with the arm 43c of the release lever 43 so as to release the arm 42b of the driving lever 42 from the arresting shoulder 43a of the lever 43 so that the printing ring supporting lever 8 is moved by the driving lever 42 for the orbital movement of the printing ring 1 to abut the same against the platen 14, while the two dot line shows the cam 47 in the position having been rotated after disengaged from the lever 43 and the select lever 51 in the position ready for arresting the arm 42c of the driving lever 42 by the deenergization of the electromagnet member 24.

Figure 13:
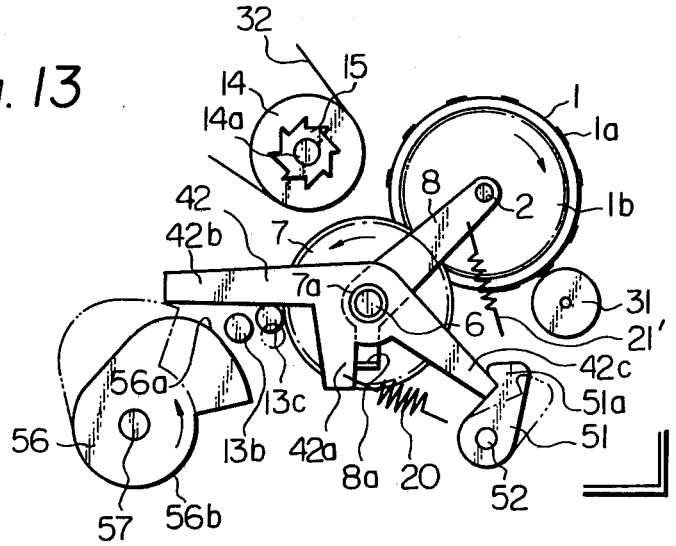
FIG. 13 is a schematic side view similar to FIG. 11 but showing a still other embodiment of the present invention.
Figure 14:
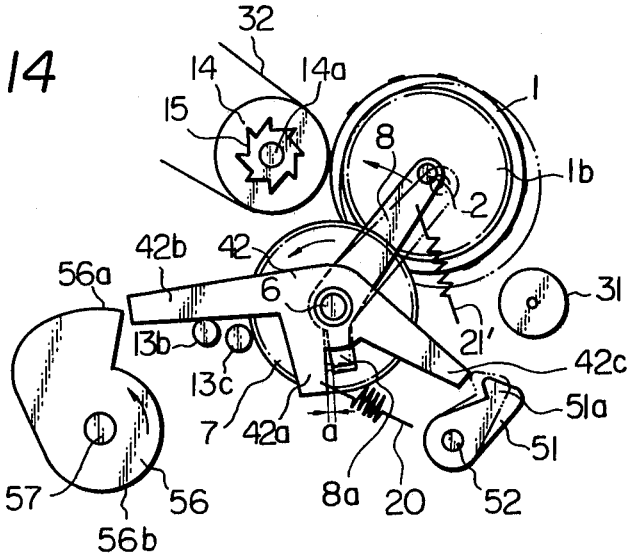
FIG. 14 is a view similar to FIG. 13 but showing the embodiment in another condition of operation.

FIGS. 13 and 14 show a modification of the embodiment shown in FIG. 10. In this embodiment, the respective release lever 43 of the embodiment shown in FIG. 10 is dispensed with, and a cam 56 driven by a shaft 57 is replaced for the cam 47 in FIG. 10.

The respective cam 56 directly cooperates with the arm 42b of each driving lever 42 so as to hold the driving lever 42 in the arrested position at least during the time prior to the disengagement of the select lever 51 until shortly after the disengagement thereof (FIG. 13), so that the driving lever 42 is released by the cam 56 for the actuation of the driving lever 42 in exact timed relation to the selection of the desired character after the select lever 51 has been disengaged from the driving lever 42 (FIG. 14).

Although not shown in the drawing, the reset lever 13 having the reset shaft 13c may be dispensed with in the embodiment shown in FIGS. 13 and 14.

In this case, the cam 56 per se serves as the reset means so that the driving lever 42 is arrested by the select lever 51 after the actuation of the driving lever 42 for the printing operation by the select lever 51 which has restored its position by the deenergization of the electromagnet member 24 as the cam 56 rotates.

This embodiment permits multiple printing of characters 1a on each printing ring 1 during one revolution thereof or one cycle of the printing operation, because the orbital movement of each printing ring 1 is controlled by the cam 56 rotated by one revolution each time the respective printing ring 1 is rotated by an angular pitch formed between the adjacent two characters 1a on each printing ring 1 instead of the reset lever which is actuated once at the end of each cycle of the printing operation so as to reset the respective driving lever.

Figure 15:
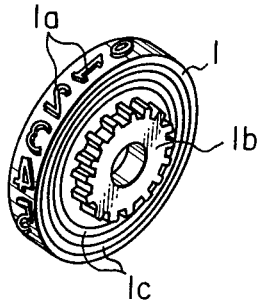
FIG. 15 is a perspective view showing an embodiment of the printing ring of the present invention.

FIG. 15 shows an example of the printing ring 1 adapted to be used in the present invention. The printing ring 1 shown in FIG. 15 is provided with one or more concentric annular grooves 1c at least at the side surface of the printing ring 1 at which the gear 1b is secured, the grooves being positioned around the gear 1b spaced therefrom.

These grooves 1c positively prevent ink supplied to the periphery of the printing ring 1 from flowing inwardly to stick to the gear 1b and other elements in the printer to deteriorate the proper function thereof.

Figure 16:
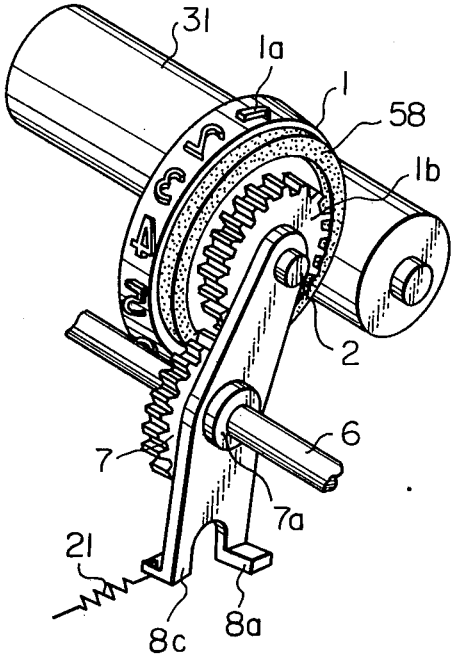
FIG. 16 is a fragmentary perspective view showing another embodiment of the printing ring of the present invention.

FIG. 16 shows a modification of the embodiment shown in FIG. 15. In this embodiment, an annular spacer ring 58 is attached at least to the side surface of the printing ring 1 around the gear 1b spaced therefrom. The spacer ring 58 is made of material capable of absorbing ink and preventing ink from flowing inwardly to deteriorate the function of the printer.

Figure 17:
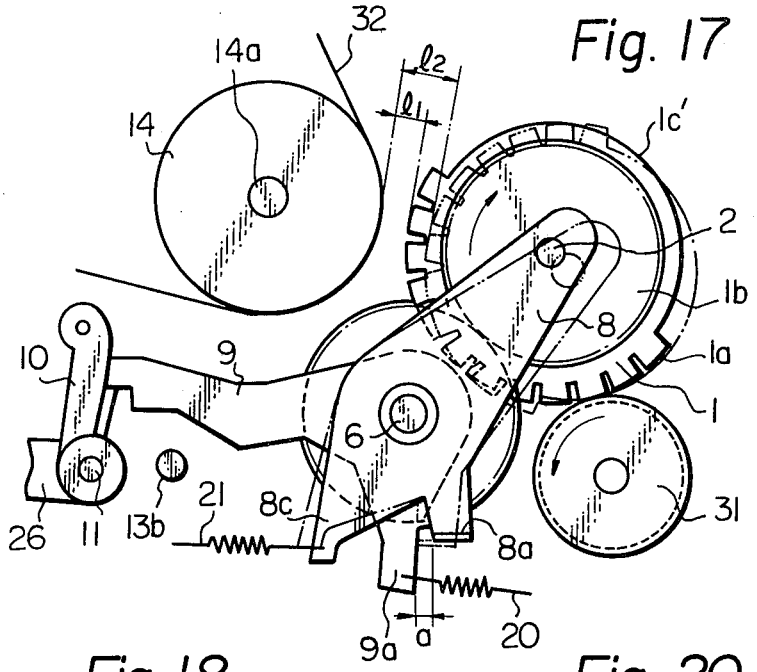
FIG. 17 is a schematic side view showing an embodiment of the present invention.

FIG. 17 shows the behaviour the respective printing ring 1 of the conventional type having raised characters 1a on a portion of the periphery thereof, the remaining portion 1c' being recessed from the imaginary peripheral surface in which the surface of each character lies.

As shown in FIG. 17, the distance $l_1$ between the platen 14 and the printing ring 1 when the raised surface of the characters 1a contacts with the ink roller 31 as shown by the solid line is smaller than the distance $l_2$ between the platen 14 and the printing ring 1 when the recessed portion 1c' of the printing ring 1 contacts with the ink roller 31 as shown by the dot chain line, while the distance a between the arm 8b of the respective printing ring supporting lever 8 and the arm 9a of the corresponding driving lever 9 is greater in the case the printing ring 1 is positioned as indicated by the solid line than the case in which the printing ring 1 is positioned as indicated by the dot-chain line.

Thus, the time period between the actuation of the driving lever 9 and the abutment of the printing ring 1 against the platen 14 for the printing operation is made shorter in case the printing ring 1 is positioned as indicated by the solid line in comparison with the case in which the printing ring 1 is positioned as shown by the chain-dot line. The reason therefor is that the driving lever 9, upon releasing thereof, gains acceleration in the swinging movement thereof as the lapse of time increases so that a greater impact force is given to the printing ring supporting lever 8 which it locates the printing ring 1 thereon in the position indicated by the solid line so as to urge the same at a higher velocity than in the case of the printing ring 1 being located as shown by the chain line to abut the printing ring 1 against the platen 14, while the distance $l_1$ is smaller than the distance $l_2$ requiring shorter time until the printing ring 1 abuts against the platen 14. This causes the erroneous printing of the printer.

Figure 18:
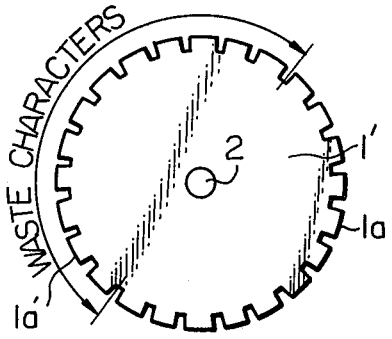
FIG. 18 is a plan view showing an embodiment of the printing ring of the present invention.
Figure 19:
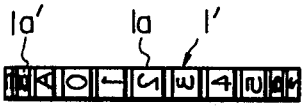
FIG. 19 is a side view of FIG. 18.

In accordance with the feature of the present invention, waste characters 1a' are provided along the recessed portion 1c' of the periphery of the printing ring 1 as shown in FIGS. 18 and 19 so that the entire periphery of the printing ring 1 is in the same peripheral surface. Thus, the above described difficulties are avoided and proper printing operation is insured.

Figure 20:
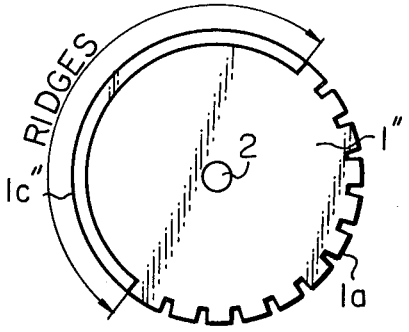
FIG. 20 is a plan view showing another embodiment of the printing ring of the present invention.
Figure 21:
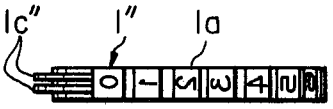
FIG. 21 is a side view of FIG. 20.

FIGS. 20 and 21 show a modification of the embodiment shown in FIGS. 18 and 19. In this embodiment, the waste characters 1*a*′ are replaced by a pair of circumferentially extending ridges 1*c*″ located in the recessed portion 1*c*′ of the printing ring 1 so that the entire periphery thereof is held in the same peripherl surface. The function of the embodiment of FIGS. 20 and 21 is similar to that of FIGS. 18 and 19.

I claim:

1. Printer having a plurality of rotatable printing rings each bearing on the periphery thereof a plurality of printing characters and a platen, each of said printing rings being individually moved selectively by means of a driving shaft driven by a driving motor toward said platen after selection of a desired character from said plurality of characters during the rotation of each printing ring upon issuance of a printing signal from a control circuit of said printer so to permit a line of printing of desired characters to be given on a paper located around said platen between said platen and said printing rings by the abutment of the respective printing rings against said platen during a predetermined number of revolution of said driving shaft, wherein the improvement comprises in combination a gear integral with each printing ring, a plurality of swingable printing ring supporting levers each having a shaft secured to the free end of said lever, said shaft rotatably supporting the respective printing ring, each of said printing ring supporting levers being biased by a spring so as to be swung in the direction to move said printing ring supported thereon away from said platen, a plurality of driving gears secured to said driving shaft and each meshing with said gear of the respective printing ring so as to rotate the latter about the axis of said shaft for selection of a desired character by said printing signal, each printing ring supporting lever being swingably supported on said driving shaft so as to permit each printing ring to move in orbital path around said driving shaft and abut against said platen, a plurality of driving levers swingably supported on said driving shaft and each biased by a spring in the direction in which said printing rings are moved toward said platen, each of said driving levers engaging with the respective printing ring supporting lever so as to urge said printing ring thereon toward said platen against the action of said spring of said printing ring supporting lever, a plurality of select levers each releasably arresting the respective driving lever at a position in which each printing ring is held apart from said platen by the engagement of the respective printing ring supporting lever with said driving lever, a plurality of electromagnetic members selectively actuated for a short time by said control circuit upon issuance of the printing signal and each coupled with the respective select lever so that, when the respective electromagnetic member is actuated in synchronism with the selection of said desired character during the rotation of said printing ring, said select lever coupled therewith is moved to release said driving lever arrested thereby so as to permit the same to be swung by said spring thereof for urging said printing ring supporting lever to move said printing ring thereon toward said platen, stopper means for limiting the swinging movement of each driving lever to a position whereby said printing ring supporting lever is swung further together with said printing ring thereon by virtue of the inertia thereof against the action of said spring thereof after said driving lever is stopped by said stopper means thereby permitting said printing ring to abut against said platen for the printing operation while the respective printing ring supporting lever is swung back by said spring thereof after the abutment of said printing ring thereof against said platen so as to be held by said driving lever which is held at said stopped position by said stopper means thereby clearing said printing ring from said paper, reset means engageable with the respective driving lever and actuated in synchronism with the rotation of said driving shaft so as to allow each driving lever to be swung for actuating the respective printing ring supporting lever after releasing of said driving lever from said select lever at the beginning of the rotation of said driving shaft while said reset means urges each driving lever upon completion of said predetermined number of revolution of said driving shaft so that the respective driving lever is arrested by said select lever thereof which has restored its initial position by the deactuation of said electromagnetic member thereof to return each printing ring at its initial starting position, signal emitting means rotated in synchronism with said driving shaft, signal receiving means cooperating with said signal emitting means so as to issue an electrical signal each time one cycle of the printing operation is effected by the rotation of said driving shaft, said electrical signal being applied to said control circuit for controlling the starting and stopping of the operation of said printer, a detecting disc rotated in synchronism with said driving shaft and provided with a plurality of slits around the rotational axis thereof corresponding in number to that of the characters on the respective printing ring, and a detecting device cooperating with said slits in said detecting disc for issuing character synchronizing timing signals in timed relationship to the angular phases of the respective characters on each printing ring as it rotates, said timing signals being applied to said control circuit for permitting a desired character of said plurality of characters on each printing ring to be selected for the printing operation during the rotation of the respective printing ring.

2. Printer according to claim 1, wherein said reset means comprises a reset lever swingably supported on a reset lever supporting shaft arranged beneath said driving levers and said driving shaft, said reset lever having a reset shaft secured thereto and extending beneath each driving lever as well as a cam follower shaft secured thereto at a position beneath said driving shaft and urged by a spring toward said driving levers and said driving shaft, a reset cam secured to said driving shaft and engaging with said cam follower shaft, said reset cam being so configured with respect to said cam follower shaft that said reset lever is swung at the beginning of the rotation of said driving shaft so as to move said reset shaft away from each driving lever thereby permitting the same to be swung upon releasing thereof from said select lever while said reset lever is swung back by said reset cam by the action of said spring thereof upon said predetermined number of revaluation of said driving shaft after completion of the printing operation thereby urging each driving lever so as to be arrested by the respective select lever which has been restored its initial position by the deactuation of said electromagnetic member thereof.

3. Printer according to claim 2, further comprising an arresting claw formed at the free end of said reset lever, a swingable hook lever swingably supported by a shaft adjacent to said arresting claw and having a hook portion, cooperating with said arresting claw and an elongated arm at the free end thereof, said hook lever being urged by a spring toward said reset lever, and an actuating pin secured to said reset cam and cooperating with said elongated arm of said hook lever, thereby permitting said arresting claw to be releasably arrested by said hook portion of said hook lever when said reset lever is swung by said reset cam at the beginning of rotation of said driving shaft for maintaining the same at a position in which it permits the respective driving lever to be swung for the actuation of each printing ring without requiring said cam follower shaft of said reset lever to continuingly contact frictionally with said reset cam while said actuating pin abuts against said elongated arm upon said predetermined number of rotation of said driving shaft thereby swinging said hook lever for releasing said arresting claw from said hook portion so as to permit said reset lever to be swung causing the respective driving lever to be arrested by said select lever without requiring said reset cam to frictionally contact continuingly with said cam follower shaft.

4. Printer according to claim 2, wherein the improvement further comprises a rotatable shaft fixedly securing thereon said platen so as to rotate the same therewith, a ratchet wheel secured to said rotatable shaft, a claw lever swingably supported by said cam follower shaft of said reset lever and having a claw, said claw lever being ruged by a spring toward said ratchet wheel so as to engage said claw with said ratchet wheel, thereby permitting said rotatable shaft of said platen to be stepwise rotated together with said platen at the end of said predetermined number of rotation of said driving shaft by the engagement of said hook lever with said ratchet wheel so as to feed said paper located around said platen after completion of the printing operation.

5. Printer according to claim 2, wherein said topper means is constituted by said reset lever supporting shaft.

6. Printer according to claim 1, wherein said reset means comprises cam means rotated by said driving shaft by one revolution each time said printing rings are rotated by an angle corresponding to the pitch angle formed between adjacent two characters of said plurality of characters on each printing ring and engaged with the respective driving lever so that the same is swung back by said cam means so as to be arrested by said select lever thereof which has restored its initial position by the deactuation of said electromagnetic member.

7. Printer according to claim 6, wherein the respective driving lever includes an additional arm and said cam means engages with said additional arm so that the respective driving lever is released for moving the respective printing ring for the printing operation in properly synchronized relationship to the selection of a desired character on the respective printing ring for the printing operation regardless of the variation in time of the mechanical releasing of said driving lever from said select lever by the actuation of said electromagnetic member.

8. Printer according to claim 1, wherein the improvement further comprises a rotatable shaft fixedly securing thereon said platen so as to rotate the same therewith, a ratchet wheel secured to said rotatable shaft, a claw lever swingably supported by a pin secured to a swingable lever pivoted in said printer, said claw lever having a claw cooperating with said ratchet wheel, said claw lever being urged toward said ratchet wheel by a spring so as to engage said claw with said ratchet wheel, and a cam secured to said driving shaft and engaging with said swingable lever thereby permitting said rotatable shaft of said platen to be stepwise rotated together with said platen by the engagement of said hook lever with said ratchet wheel at the end of said predetermined number of rotation of said driving shaft so as to feed said paper located around said platen.

9. Printer according to claim 1, wherein said driving shaft is rotated by one revolution by means of a worm gear mechanism by said driving motor for completing one cycle of printing operation.

10. Printer according to claim 1, further comprising intermittent transmission means interposed between said driving motor and said driving shaft so as to intermittently rotate each printing ring for the selection of a desired character from said characters on the respective printing ring while the same is stopped its rotation for the printing operation.

11. Printer according to claim 10, wherein said intermittent transmission means comprises Geneva gear mechanism.

12. Printer according to claim 1, wherein the improvement further comprises an additional arm integrally formed on the respective driving lever, a cam rotated by said driving shaft by one revolution each time said printing rings are rotated by an angle corresponding to the pitch angle formed adjacent two characters of said plurality of characters on the respective printing ring and cooperating with said additional arm so that the respective driving lever is released for moving the respective printing ring for the printing operation in properly synchronized relationship to the selection of a desired character on the respective printing ring regardless of the variation in time of the mechanical releasing of said driving lever from said select lever by the actuation of said electromagnetic member.

13. Printer according to claim 12, further comprising a swingable two-arm lever interposed between said additional arm of the respective driving lever and said cam, one of the two arms of said lever releasably engaging with said additional arm and the other arm cooperating with said cam, said lever being urged by a spring so as to urge said one arm in engagement with said additional arm, thereby permitting said one arm to be released from said additional arm by the actuation of said cam after said select lever is released from said driving lever bythe deactuation of said electromagnetic member.

14. Printer according to claim 1 and having an ink roller adapted to rollingly contact with the respective printing ring for applying ink thereto when the same is held apart from said platen by the respective driving lever which is arrested by said select lever, wherein the improvement comprises at least an annular groove formed on either side surfaces of the respective printing ring adjacent to the periphery thereof for preventing ink applied to said printing ring from flowing inwardly thereof affecting the proper operation of said printer.

15. Printer according to claim 1 and having an ink roller adapted to rollingly contact with the respective printing ring for applying ink thereto when the same is held apart from said platen by the respective driving lever which is arrested by said select lever, wherein the improvement comprises annular ink absorbing spacer ring means attached to at least one side surface of the respective printing ring on which said gear is secured, said spacer ring means being spaced outwardly from said gear thereby preventing ink from flowing inwardly to said gear affecting false function thereof.

16. Printer according to claim 1 wherein an ink roller is provided which is adapted to rollingly contact with the respective printing ring for applying ink thereto when the same is held apart from said platen by the respective driving lever which is arrested by said select lever and each of said printing rings has said plurality of characters arranged in a portion of the entire periphery protrudingly from the peripheral surface thereof, wherein the improvement comprises a protruding configuration arranged along the remainder of the entire periphery of the respective printing ring so as to provide an even circular peripheral surface thereof passing through top surfaces of said characters and said protruding configuration for rollingly contacting with said ink roller, thereby permitting the respective printing ring to be abutted in properly timed relationship with the releasing of said driving lever regardless of the angular position of the respective printing ring for the selection of a desired character.

17. Printer according to claim 16, wherein said protruding configuration comprises waste characters.

18. Printer according to claim 16, wherein said protruding configuration comprises at least a circumferentially extending protruding ridge.

* * * * *

UNITED STATES PATENT AND TRADEMARK OFFICE

CERTIFICATE OF CORRECTION

PATENT NO. : 4,095,686

DATED : June 20, 1978

INVENTOR(S) : Katsuhiko Okabe

It is certified that error appears in the above-identified patent and that said Letters Patent are hereby corrected as shown below:

Column 4, line 22, "selective lever 10" should be --select lever 10--;

Column 7, line 1, "output put buffer" should be --output buffer--;

line 13, "board and applied" should be --board and applies--;

Column 9, line 60, "22 so reset" should be --22 to reset--;

Column 10, line 67, a parenthesis is started but never closed. This should be closed at the end of the line.

Column 12, line 55, "which it locates" should be --when it locates--;

Column 13, line 8, "peripherl" should be --peripheral--;

Column 14, line 32, "printing ring, and" should be --printing ring and--;

Column 15, line 28, "ruged" should be --urged--; and,

Column 16, line 46, "bythe" should be --by the--.

Signed and Sealed this

*Twentieth* Day of *March 1979*

[SEAL]

*Attest:*

RUTH C. MASON
*Attesting Officer*

DONALD W. BANNER
*Commissioner of Patents and Trademarks*